US006527000B1

(12) United States Patent
Randmae et al.

(10) Patent No.: US 6,527,000 B1
(45) Date of Patent: Mar. 4, 2003

(54) NON-CONTACT WIPER AND WASHER ASSEMBLY FOR SURVEILLANCE CAMERA DOMES

(75) Inventors: Alan Randmae, Northport, NY (US); Rein Randmae, Ft. Salonga, NY (US)

(73) Assignee: Vicon Industries, Inc., Hauppauge, NY (US)

( * ) Notice: Subject to any disclaimer, the term of this patent is extended or adjusted under 35 U.S.C. 154(b) by 67 days.

(21) Appl. No.: 09/707,741

(22) Filed: Nov. 3, 2000

Related U.S. Application Data

(60) Provisional application No. 60/163,619, filed on Nov. 4, 1999.

(51) Int. Cl.[7] ..... B08B 3/02

(52) U.S. Cl. ..... 134/99.1; 134/102.1; 134/198; 15/250.01; 15/250.001; 239/284.1

(58) Field of Search ..... 239/284.1, 284.2; 15/250.001, 250.01, 250.02; 134/198, 201, 99.1, 95.3, 99.2, 102.1

(56) References Cited

U.S. PATENT DOCUMENTS

| | | | | |
|---|---|---|---|---|
| 2,896,245 A | | 7/1959 | Hopponen | |
| 3,086,239 A | | 4/1963 | Peras | |
| 3,656,691 A | | 4/1972 | Norstrand | 239/284 |
| 3,667,082 A | * | 6/1972 | Hoyler | |
| 3,719,819 A | | 3/1973 | Lowell | 240/7.1 |
| 3,835,499 A | | 9/1974 | Bender | 15/250.04 |
| 3,879,742 A | | 4/1975 | Smith | 354/64 |
| 3,915,385 A | | 10/1975 | Hassinger | 239/284 |
| 3,939,523 A | | 2/1976 | Kolbe et al. | 15/250.02 |
| 4,021,878 A | | 5/1977 | Peillex | 15/250.28 |
| 4,026,468 A | * | 5/1977 | Tinder et al. | |
| 4,088,358 A | | 5/1978 | Hirsch | 239/284 |
| 4,105,248 A | | 8/1978 | Lake | 296/84 |
| 4,248,383 A | * | 2/1981 | Savage et al. | |
| 4,324,363 A | * | 4/1982 | Rauen, Jr. | |
| 4,611,761 A | | 9/1986 | Pollard | 239/284 |
| 4,752,032 A | | 6/1988 | Costa et al. | 239/284.2 |
| 4,908,903 A | | 3/1990 | Mori | 15/250.04 |
| 5,005,248 A | | 4/1991 | Bonar | 15/250.04 |
| 5,083,339 A | | 1/1992 | Bristow | 15/250 |
| 5,208,938 A | | 5/1993 | Webb | 15/250.22 |
| 5,383,247 A | | 1/1995 | Nickel | 15/250.04 |
| 5,418,567 A | * | 5/1995 | Boers et al. | |
| 5,518,553 A | | 5/1996 | Moulder | 134/22.18 |

FOREIGN PATENT DOCUMENTS

| | | | |
|---|---|---|---|
| JP | 10-216049 | * | 8/1998 |
| JP | 10-216666 | * | 8/1998 |

* cited by examiner

*Primary Examiner*—Frankie L. Stinson
(74) *Attorney, Agent, or Firm*—Darby & Darby

(57) ABSTRACT

A non-contact wiper and washer assembly for surveillance camera domes having a semicircular perforated tube in close proximity to the dome surface. The tube is pivotable by a motorized mechanism so that either washer solution or compressed air may be dispensed over the entire surface of the dome thereby washing it and cleaning it from any water droplets.

8 Claims, 6 Drawing Sheets

NON-CONTACT WIPER AND WASHER ASSEMBLY FOR SURVEILLANCE CAMERA DOMES

This application claims priority pursuant to 35 U.S.C. 119 based upon U.S. Provisional Patent Application Serial No. 60/163,619 filed Nov. 4, 1999, the entire disclosure of which is hereby incorporated by reference.

FIELD OF THE INVENTION

The present invention relates generally to non-contact wiper and washer assemblies and, more particularly, to non-contact wiper and washer assemblies for surveillance camera domes.

BACKGROUND OF THE INVENTION

Today, in the security industry, more and more emphasis is placed on discreet video surveillance by means of video cameras placed in housings having hemispherical transparent plastic domes. The camera is remotely rotated and pivoted within the dome so that the whole hemispherical viewing area may be surveyed.

It is extremely important that the camera have an unobstructed view of the viewing area at all times. This has not always been possible in the case of outdoor locations due to weather conditions, dust and other contamination that settle on the dome surface. Previously, there had been no easy method to remove water droplets from the surface of a plastic dome, nor to clean the surface of a dome other than manually cleaning it. The plastic material that the dome is made of is, by necessity, relatively soft and prone to nicks and scratches which will impair vision through the dome. Therefore, extreme care had to be exercised when cleaning the dome surface. This process has been necessarily time consuming and expensive and has often required premature replacement of the dome. Furthermore, cameras are frequently located at elevated or inaccessible locations requiring specialized equipment to gain access to them and making the process of cleaning the dome even more expensive.

The object of the invention is to provide a device which enables cleaning and wiping of a dome surface from a remote location without physically touching the surface.

It is also an object an advantage of this invention to reduce the cost of periodic maintenance of surveillance domes by providing a means for remotely cleaning the dome surface without the need for gaining physical access to dome.

It is a further object of this invention to provide a method for cleaning a dome exterior without touching its surface, thereby eliminating the possibility of scratching the surface.

It is a further object of this invention to avoid premature replacement of a plastic surveillance dome due to improper cleaning practices.

It is still another object of this invention to provide a device for wiping a dome surface clean of water droplets without physically touching its surface.

SUMMARY OF THE INVENTION

This invention provides a non-contact wiper and washer system for surveillance domes enabling an operator at a remote location to:

1. wipe the surface of the dome free of water droplets in rainy weather; and
2. wash and wipe the surface of the dome when contamination is present.

A semicircular thin walled tube is attached to the dome assembly, the tube being at all points in close proximity to the transparent dome surface. The tube has many small perforations placed so that compressed air or window washer solution may be dispensed at high pressure onto the dome surface. The semicircular tube is pivotable about an axis running through the center of the dome such that when pivoted 180 degrees, the whole surface of the dome may be cleaned. A remotely controlled electric motor is connected to the tube through a linkage transmission enabling it to move in the aforementioned manner.

In a preferred embodiment, the tube is connected to a pressurized supply tank containing window washer solution and air. The tank may be placed at a distance from the dome assembly. The connection to the tank is made by means of two supply lines, one from the top of the tank and the other from the bottom, enabling either air or washer solution to be dispensed. The connection is made through a "T" fitting and two electro-mechanical valves which may also be remotely controlled. The valves are controlled by logic circuitry to allow the operator to select either continuous wiper operation in case of wet or rainy weather conditions, or a wash cycle in the event the dome surface must be cleaned. The wash cycle may be automatically followed by a wipe cycle.

Pressurization of the supply tank may be accomplished by any convenient means such as an air compressor, compressed air bottle, hand pump or an existing compressed air line.

DETAILED DESCRIPTION OF THE PREFERRED EMBODIMENT

Figure 1:
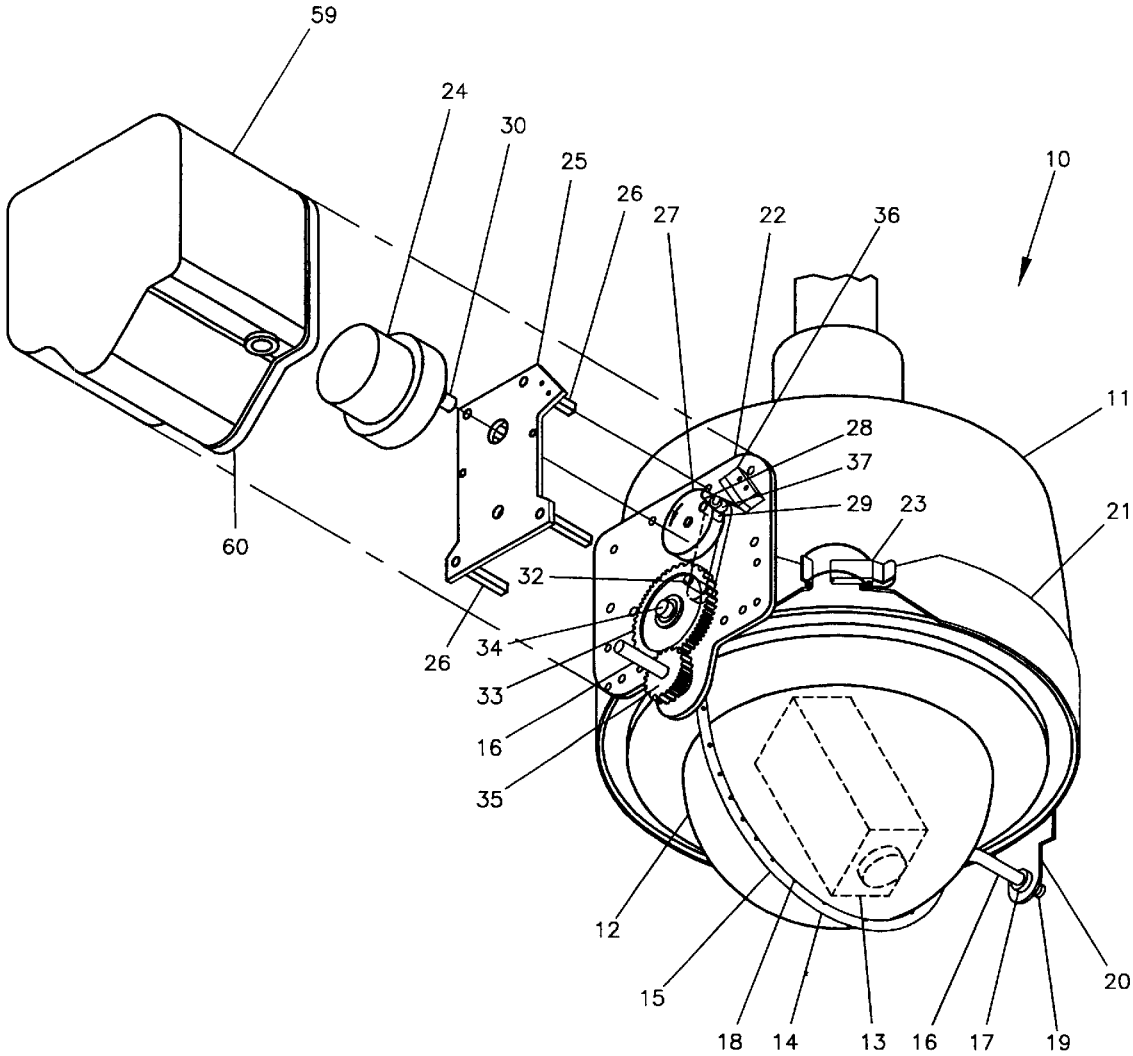
FIG. 1 is a partially exploded perspective view of a surveillance camera housing having a transparent plastic dome showing the preferred embodiment of the invention.

Referring to the figures, the following description illustrates the preferred embodiment of the invention. FIG. 1 shows in general a video camera housing 10 and in particular an upper housing 11 enclosing a mechanism for pivoting the camera in azimuth and elevation and a transparent hemispherical dome 12 in the center of which a video camera 13 is located.

A semicircular thin walled tube 14, made of a rigid material such as copper, having a curved portion 15 and axial portions 16 encircles the dome 12 in close proximity to it. Axial portions 16 of the tube 14 are mounted in bearings 17 enabling it to pivot along an axis through the center of the dome 12 thus allowing the curved portion 15 to sweep over the entire dome surface in an arc of 180 degrees. A series of closely spaced, small diameter holes 18 are punched into the inside facing surface of the curved portion 15 of the tube 14 to allow air or window washer solution to be dispensed at high pressure onto the surface of dome 12. One end of the tube 14 is closed by a cap 19, the other being open to receive fluid.

Bearings 17 are supported at one end of the tube 14 by a downwardly protruding tab 20 attached to a circumferential hoop 21 and at the other end by a plate 22, also attached to a hoop 21. The hoop 21 is clamped around the circumference of the housing 11 by a spring latch 23 and is held in position by frictional force.

The plate 22 also serves as a base for a drive assembly 40 which contains components for pivoting the tube 14 through a 180 degree angle, for controlling the delivery of air or fluid to the tube 14 and for logic circuitry for remotely controlling the wiper and washer action. In detail, referring to FIG. 1 and FIG. 2, a geared electric motor 24 is rigidly mounted to a sub-plate 25 offset from the plate 22 by spacers 26. A cylindrical cam 27 having a flatted portion 28 and a drive pin 29 is affixed to a motor shaft 30. A drive link 31 rotatably engages both the drive pin 29 and a pin 32 affixed to a gear 33 which rotates on a stud 34 fixed to the sub-plate 25. Gear 33 meshes with a pinion 35 rigidly attached to the axial portion 16 of the tube 14. A snap action switch 36 mounted to the sub-plate 25 has a roller actuator 37 resting on the cylindrical surface of the cam 27. A flatted portion 28 on the cam 27 causes a switch 36 to actuate once each revolution of the cam 27. The drive assembly 40 is enclosed in a cover 59 and sealed from water entry by a gasket seal 60.

Figure 3A:
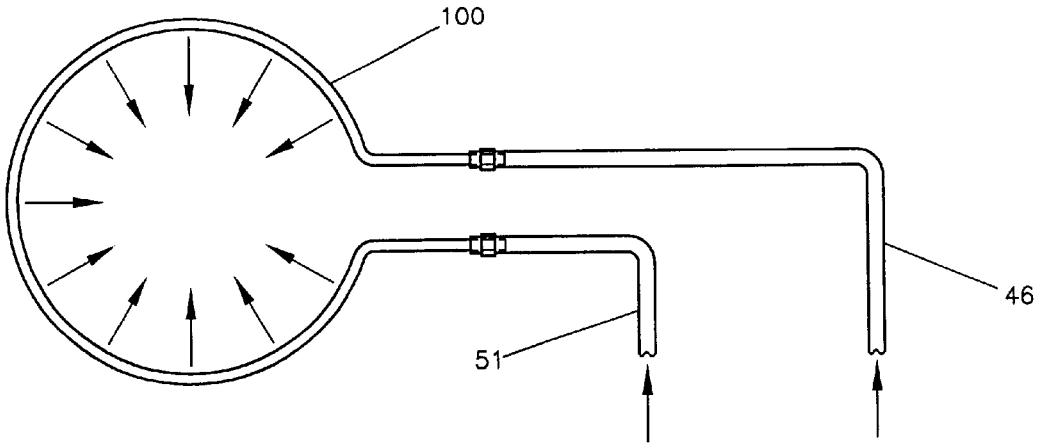
FIG. 3A is a diagram of an alternate fluid circuit for another embodiment of the invention.
Figure 3:
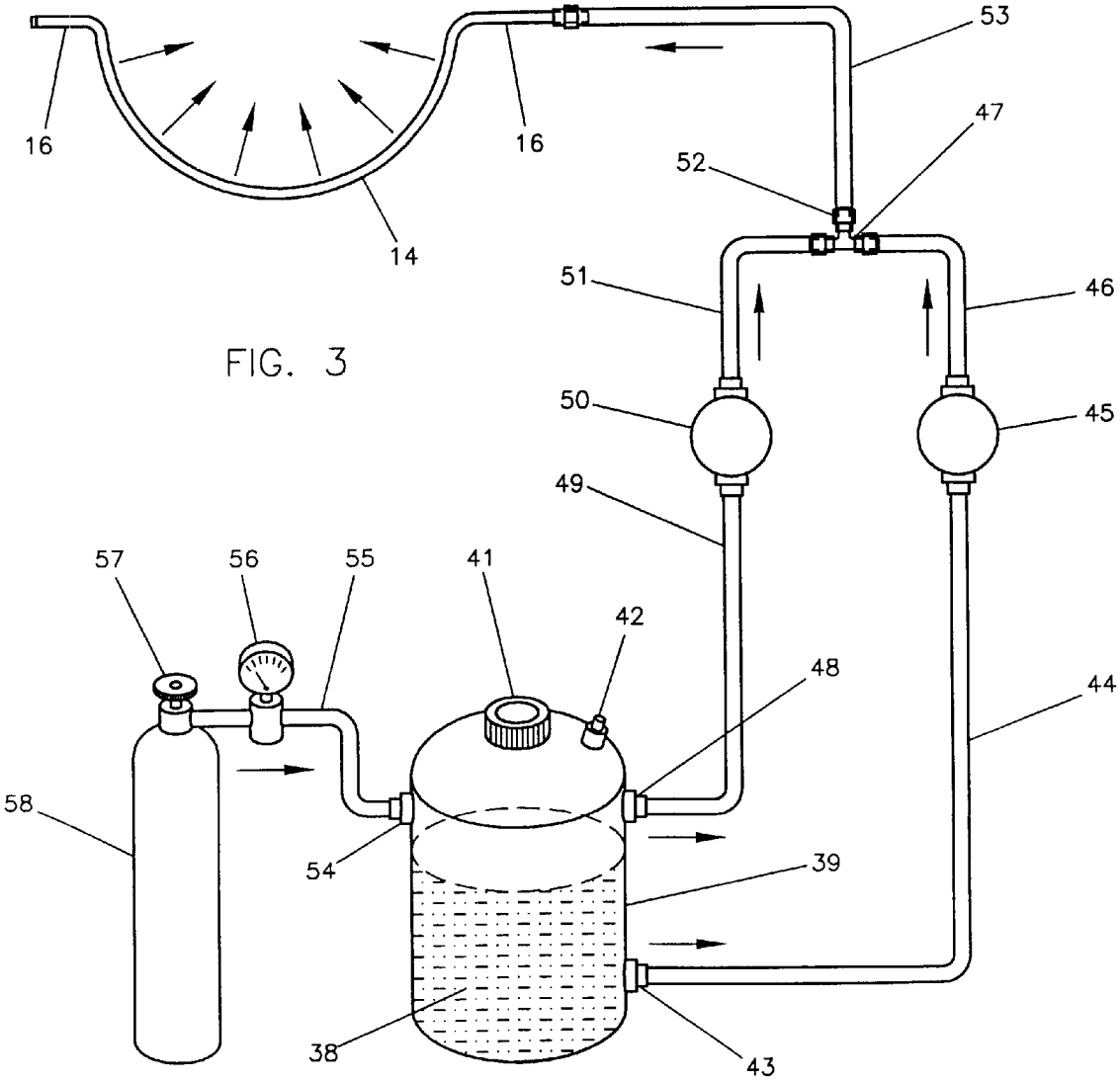
FIG. 3 is a diagram of the fluid circuit of the preferred embodiment showing the fluid supply tank, air supply bottle and control valves.

Referring to FIG. 3, washer solution 38 is contained in a tank 39 of any convenient size having a filler cap 41, a pressure relief valve 42 and three fittings. A fitting 43, located near the bottom of the tank 39, connects to a washer solution supply conduit 44 which further connects through an electromechanical valve 45 and a conduit 46 to a "T" fitting 47. A fitting 48 near the top of the tank 39 connects to a wiper air supply conduit 49 which further connects through an electromechanical valve 50 and a conduit 51 to a "T" fitting 47. An output branch 52 of the "T" fitting 47 connects through a common supply conduit 53 to the open end of the tube 14 thereby enabling either air or washer solution to be delivered by command. The conduit 53 should be made of a flexible material such as soft vinyl to allow the axial portion 16 of the tube 14 to twist the required 180 degrees.

A third fitting 54 near the top of the tank 39 connects through a pressurized air conduit 55, to a pressure regulator 56 and a shutoff valve 57 to an air supply bottle 58. This arrangement allows air pressure at the top of the tank 39 to be maintained at a constant value determined by the setting of a pressure regulator 56.

Figure 4:
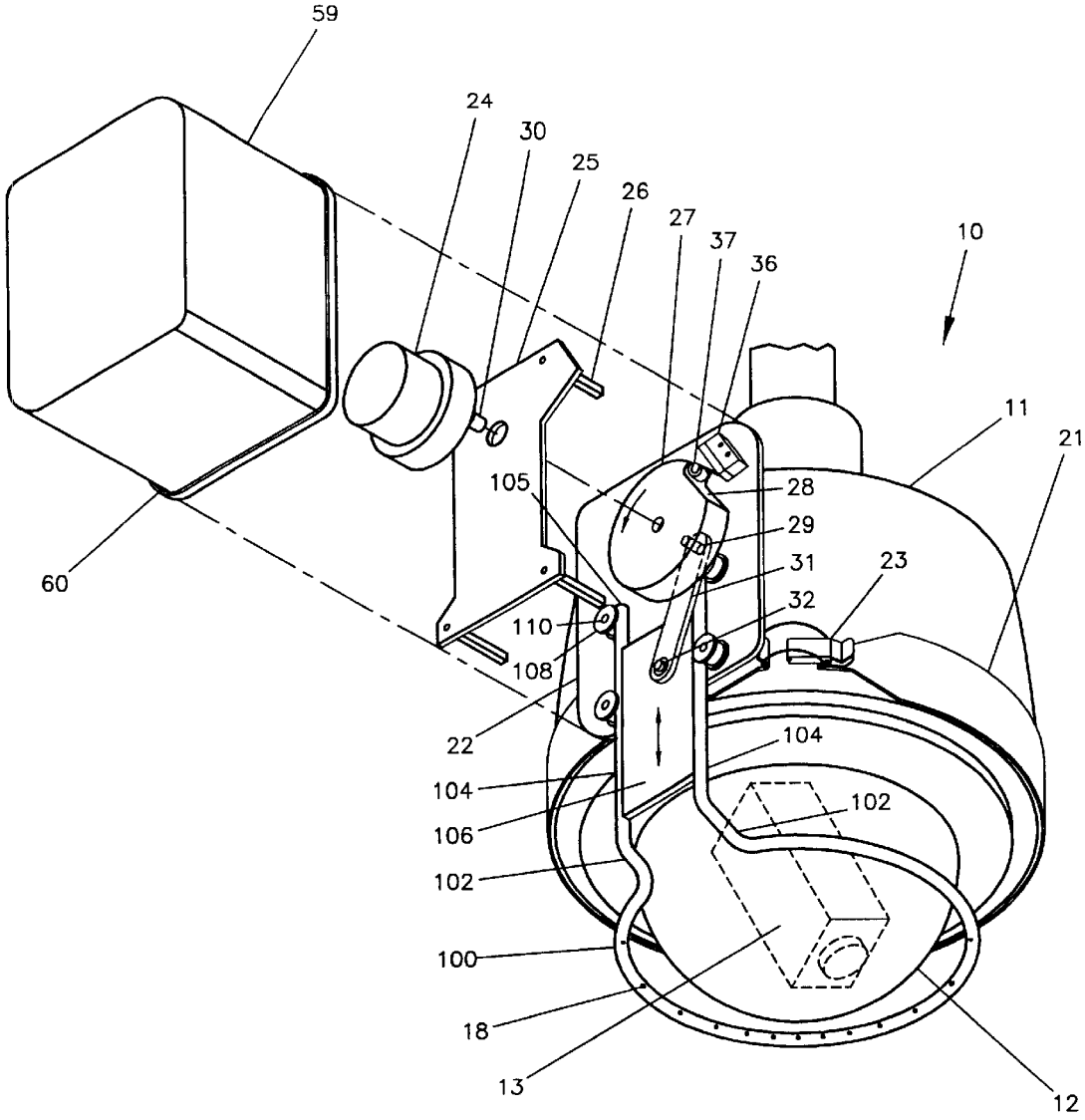
FIG. 4 is a partially exploded perspective view of another embodiment of the invention.
Figure 5:
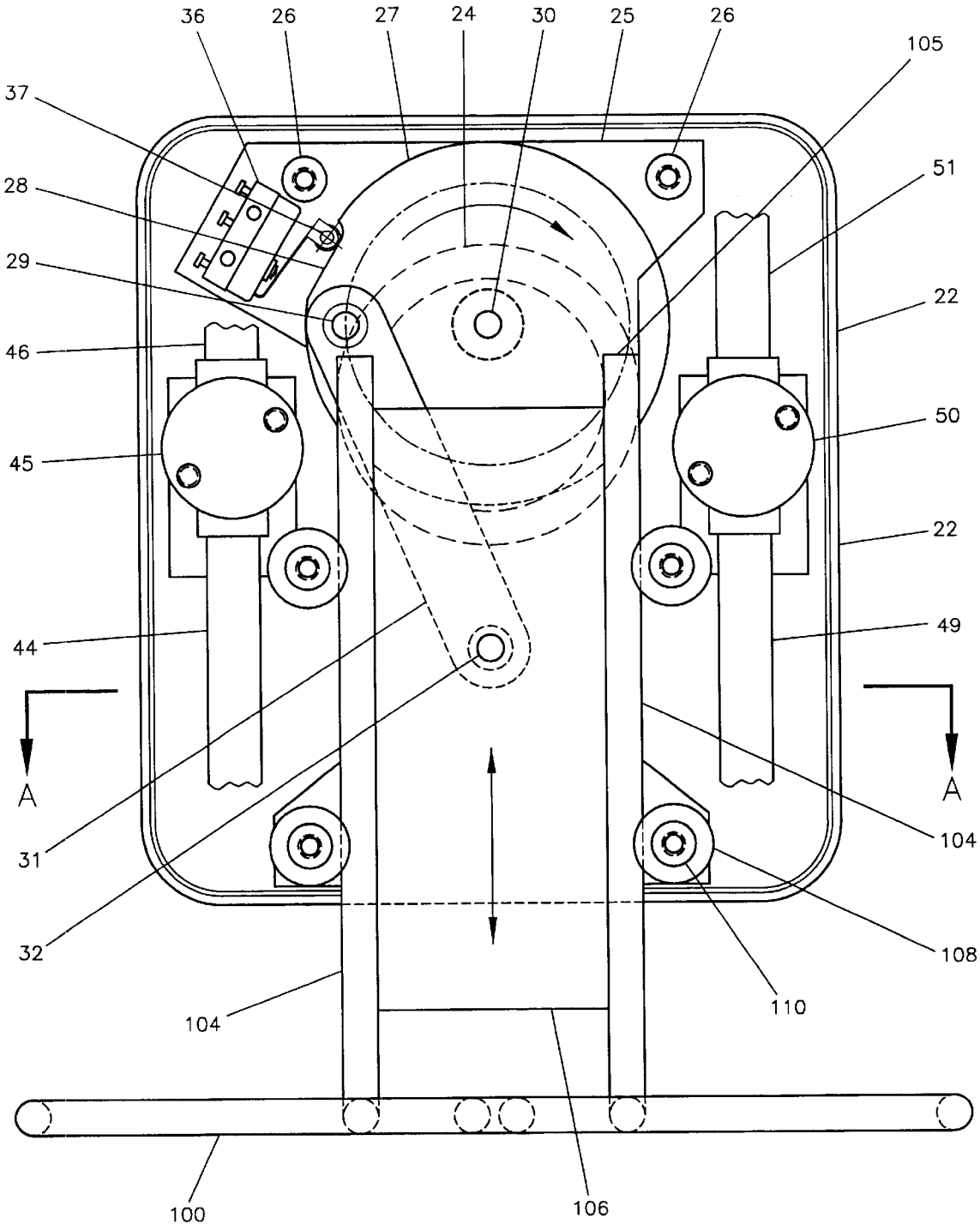
FIG. 5 is a detailed orthographic view of the drive mechanism for the wiper-washer system of another embodiment of the invention.
Figure 6:
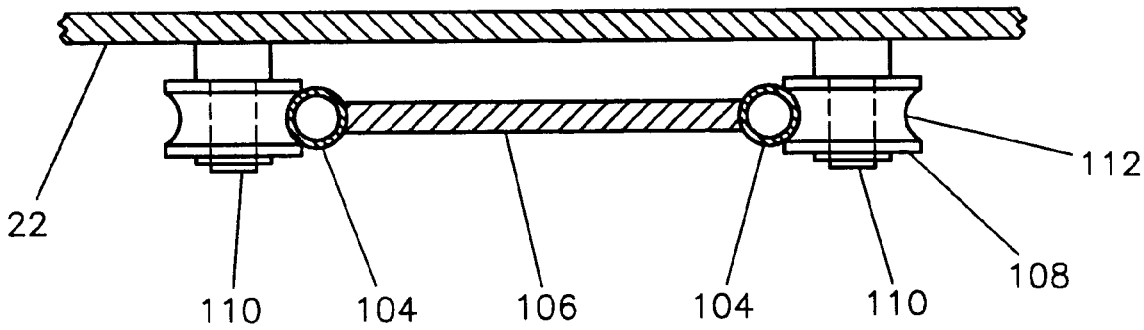
FIG. 6 is a sectional view taken along line A—A in FIG. 5 showing a detail of the tube elevation mechanism.

Another embodiment of the invention is shown in FIG. 4 where the semicircular tube 14 (shown in FIG. 1 and FIG. 2) has been replaced by a horizontally situated circular tube 100 formed to have radially outward protruding sections 102 and vertical sections 104. The horizontal portion of the tube 100 has 0.020 inch perforations in its inner circumferential surface whereby air or washer fluid may be dispensed at the surface of the dome 12. The vertical sections 104 are open at the top end 105 for directly connecting the washer solution supply conduit 46 and the wiper air supply conduit 51 without the use of a "T" fitting as shown in FIG. 3A. The vertical sections 104 are joined by a rigidizing plate 106, attached by a convenient means such as brazing or soldering. Referring to FIG. 4, FIG. 5 and FIG. 6, the vertical sections 104 are directly supported by rollers 108 with a concave circumferential surface 112 rotatably fixed to the plate 22 by shafts 110 so that the tube 100 may be lowered and raised in elevation. The fixed pin 32 in the plate 106 is rotatably connected to a link 31 whereas the other end of the link 31 is rotatably connected to the fixed pin 29 in the cam 27. The cam 27, in turn, rigidly connects to a motor shaft 30 and a motor 24. By this arrangement, the rotation of the motor shaft 30 and the cam 27 causes a linear vertical motion in the plate 106 and consequently also in the vertical sections 104 and the horizontal circular tube 100. The conduits 46 and 51 should be made of a flexible material such as vinyl and have sufficient length to allow for the required vertical motion. All other aspects of this embodiment are identical to the preferred embodiment.

Figure 2:
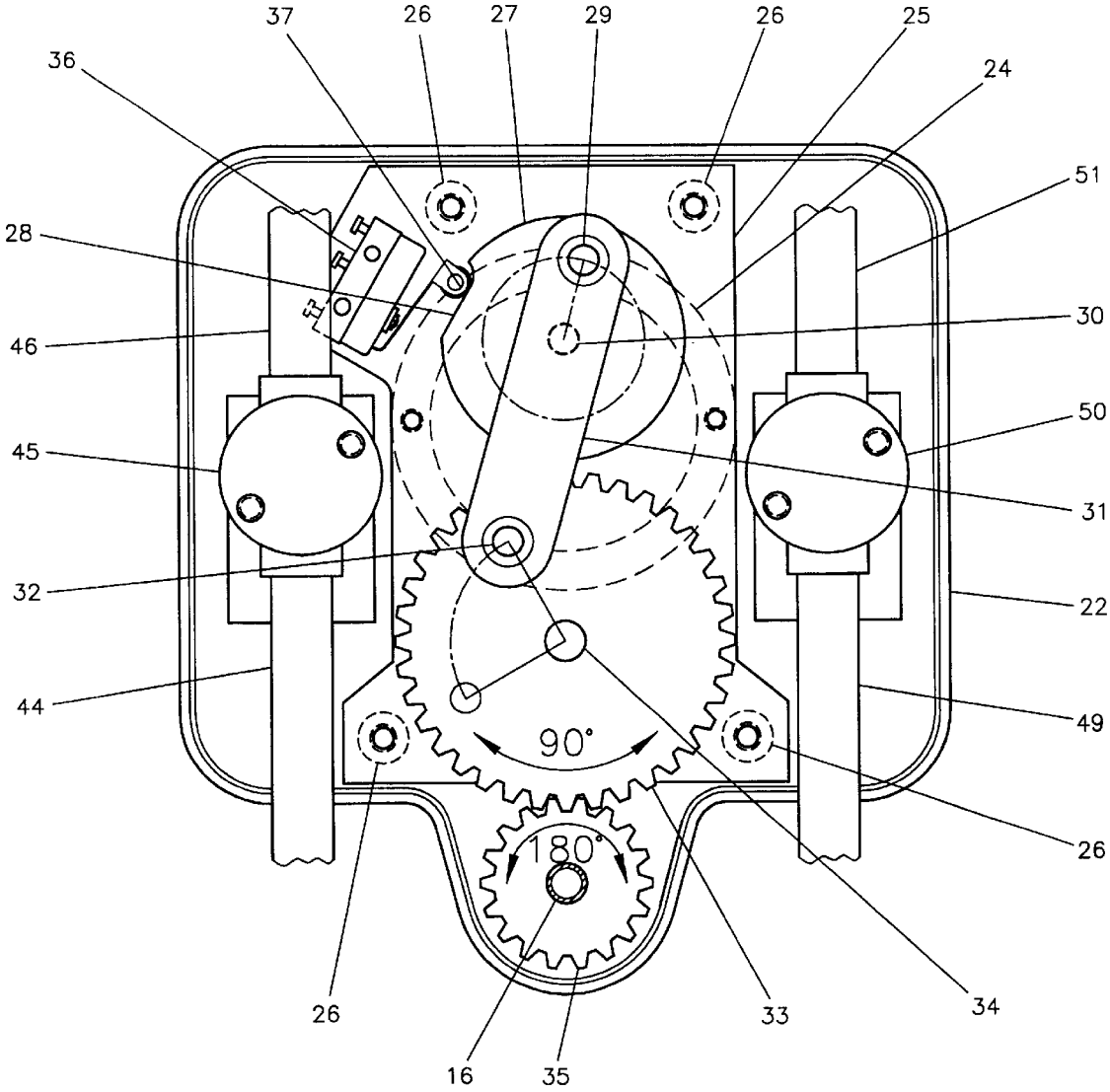
FIG. 2 is a detailed orthographic view of the drive mechanism for the wiper-washer system of the preferred embodiment of the invention.

Referring to FIG. 1 and FIG. 2, due to the gearing in the motor 24, the motor shaft 30 rotates at a relatively slow speed, such as approximately 15 revolutions per minute. This equals one full rotation in 4 seconds. As the motor shaft 30 and the cam 27 rotate, since the drive link 31 is connected to the drive pin 29 in the cam and the pin 32 in the gear 33, the gear 33 to rotates as well. Due to the geometry of this linkage and the relative offsets of the pins 29, 32 from their centers of rotation, the gear 33 rotates a total of 90 degrees clockwise and 90 degrees counterclockwise for each 360 degree rotation of the cam 27. Since the gear 33 meshes with the pinion 35 and since the pitch diameter of the gear 33 is twice the pitch diameter of the pinion 35, the pinion 35 and hence also the tube 14 rotate a total of 180 degrees. Since a snap action switch 36 actuates once each revolution of the motor shaft 30, the number of revolutions the motor shaft 30 makes and hence also the number of swipes the tube 14 makes over the dome 12 may be controlled by logic circuitry. The flatted portion 28 of the cam 27 is positioned so that when the snap action switch 36 actuates, the curved portion 15 of the tube 14 is located horizontally, therefore outside of the field of view of the camera 13. The motor 24 is of the AC synchronous type allowing instantaneous start-stop action. This characteristic aids in positioning the tube 14 precisely at its rest position.

During a continuous wiper mode of operation, the curved portion 15 of the tube 14 sweeps over the entire surface of the dome 12 once every 2 seconds. A high pressure flow of air from the perforated tube 14 blows away any water droplets present and restores a clear view for the video camera. The momentary obstruction due to the passage of the tube 14 over the field of view of the camera will not cause a meaningful lapse of surveillance.

When the dome surface must be cleaned, a washer function may be activated. In this mode of operation, washer solution is dispensed under relatively high pressure through the tube 14 for a minimum of 4 seconds while the curved portion 15 of the tube 14 executes 2 swipes over the surface. This is automatically followed by a wiper function for a minimum of 2 swipes over the dome surface to clean off the deposited washer solution along with dust, dirt etc.

Referring now to FIG. 4 and FIG. 5 for another embodiment of the invention, the motor 24 drives the cam 27 in a circular motion, causing the pin 29 and the upper end of the link 31 to also travel in a circular path. Since the lower end of the link 31 is attached to the pin 32 which is in turn attached to the plate 106 and since the plate 106 is constrained to move only in a vertical direction, the circular portion of the tube 100 will also move in a vertical direction. The stroke length in the vertical direction depends on the offset distance of the pin 29 from the center of rotation of the cam 27 and it is adjusted so that it nearly equals the vertical height of the dome 12.

During a wiper cycle, the tube 100 dispenses pressurized air which impacts the surface of the dome 12. The tube 100 is then lowered to a position nearly level with the apex of the dome 12, which action effectively drives any water droplets downward and off the surface of the dome 12.

To wash the surface of the dome 12, washer solution instead of air is dispensed, followed by a wiper cycle as described above. To effectively wash and wipe the surface of the dome 12, a pressure of approximately 25 to 35 PSI (pounds per square inch) is required in the perforated tube 14. The pressure in the tank 58 must be somewhat higher depending on the length of the supply conduits 44, 49 and the relative elevation difference of the tank 38 and the video camera housing 10.

The tank 38 may be filled by closing a shut-off valve 57, bleeding off excess pressure through a pressure relief valve 42, opening the filler cap 41 and adding washer solution to about ¾ of the tank's volume.

Although an air supply bottle 58 is indicated in the preferred embodiment shown, other means of supplying pressurized air to the tank 39 may be used, such as an air compressor, a hand pump, an existing shop air connection, etc. In case an air compressor is used, a pressure switch must be included in the tank 39 so that air pressure can be maintained within the required range.

Thus, it will be apparent to one of ordinary skill in the art that the invention provides a highly effective means of wiping and washing the surface of a plastic hemispherical dome without actually touching the surface. This eliminates the need for gaining physical access to the video camera location and minimizes the possibility of damage to the dome surface due to cleaning operations. It also makes it possible to perform these operations from a remote location eliminating service calls and thus also travel time to the camera site.

While the above description contains many specific features, these should not be construed as limitations of the invention, but rather as exemplification of preferred embodiments thereof. Many other variations are possible.

For example, the perforated tube may be formed into a ¼ circle, extending from the apex of the dome to the rim and made to encircle the dome in a horizontal direction with a pivot point at the apex of the dome. This configuration would have an advantage of requiring only a continuous circular motion rather than a cyclic motion of the wiper tube, but would limit visibility in the downward direction and also in the direction where the tube would be situated when not in use.

This invention may also be applied to a flat window. In this case the perforated tube will be straight and will be made to move across the window by mechanical means similar to the description given above. This will be of great value in cases where a plastic window is utilized, but will be of limited value where a glass window is used since a conventional contact type window wiper may be utilized without fear of scratching the surface.

The tube itself may be made from different materials such as brass, aluminum or plastic, it may have perforations of different diameters, spacings or locations on the tube. The tube may be supported or moved in various ways as long as the whole surface of the dome may be covered when wiping or washing. The drive assembly may be attached to the dome housing as shown, or to any nearby convenient rigid object. The snap action switch controlling the motion of the tube may be replaced by an optical sensing device, a magnetic or a hall effect sensor or the like. The electric drive motor may be of a different type such as induction, permanent magnet or stepper type. Another type of drive mechanism may be employed, such as belt drive, cable drive, worm gear drive or rack and pinion drive to accomplish the end result of positioning the wiper-washer tube for its intended function. The fluid lines from the supply tank to the wiper assembly may be rigid or flexible and may be made of any suitable material such as copper, brass, vinyl, urethane, silicone etc. The logic controlled fluid valves may be solenoid operated or motorized to achieve an on-off function.

A fluid supply tank may be of any convenient size, be made of steel, aluminum or plastic and have any number of fittings or accessories for connecting fluid and air supply lines. A tank may also have a filler cap or incorporate automatic means for replenishing the fluid within the tank. The storage tank may be eliminated entirely if a supply of compressed air and washer fluid under pressure is available from another source. Similarly, the air supply bottle may be eliminated, or it may be replaced by an air compressor, hand pump or an existing shop air connection.

While the invention has been particularly shown and described with reference to preferred embodiments thereof, it will be understood by those skilled in the art that variations and modifications in form and details may be made therein without departing from the spirit and scope of the invention. Accordingly, the foregoing disclosure, description, and figures are merely illustrative, and do not in any way limit the invention, which is defined solely by the claims and their legal equivalents.

What is claimed is:

1. Apparatus for enabling the contactless cleaning of a transparent dome enveloping a surveillance camera from a remote location, comprising a movable tube having a multiplicity of openings through which fluids or a gas can be directed against said dome, said tube being spaced from said dome, means for repetitively moving said tube back and forth over said dome, means for selectively supplying a cleaning liquid or a gas to said tube as it traverses said dome to remove contaminants from the surface of said dome, wherein said means for selectively supplying includes means for supplying a gas alone under pressure to said tube as it traverses said dome to remove water from the surface of said dome which would otherwise affect the image detected by the camera.

2. Apparatus according to claim 1, wherein said movable tube is curved to conform to the surface of said dome.

3. Apparatus according to claim 2, wherein said tube is rotatable about an axis which is generally coaxial with a diameter of the dome so that said curved tube traverses the surface of said dome as the tube is rotated.

4. Apparatus according to claim 3, further including a container for said cleaning liquid and gas, wherein said container includes an upper portion and a lower portion, and means for supplying gas under pressure to said container, and an upper conduit for directing said gas from said upper portion of said container to said movable tube and a lower conduit for directing said cleaning liquid from said lower portion of said container to said movable tube whereby gas or cleaning liquid may be selectively directed from said container to said movable tube.

5. Apparatus according to claim 4, wherein said means for selectively applying includes a first valve in said upper conduit and a second valve in said lower conduit whereby gas only or cleaning liquid only can be selectively supplied to said tube.

6. Apparatus according to claim 1, further including a container for said cleaning liquid and gas wherein said container includes an upper portion and a lower portion, and means for supplying gas under pressure to said container, an upper conduit for directing said gas from said upper portion of said container to said movable tube, and a lower conduit for directing said cleaning liquid from said lower portion of said container to said movable tube whereby gas or cleaning liquid may be selectively directed from said container to said movable tube.

7. Apparatus according to claim 6, wherein said means for selectively applying includes a first valve in said upper conduit and a second valve in said lower conduit whereby gas only or cleaning liquid only can be selectively supplied to said tube.

8. Apparatus according to claim 1, wherein said movable tube is in the form of a loop conforming generally to the shape of the dome and wherein one end of said loop is connected to a source of cleaning liquid and the other end is connected to a source of pressurized gas.

* * * * *